US012180951B2

(12) United States Patent
Thierley

(10) Patent No.: US 12,180,951 B2
(45) Date of Patent: Dec. 31, 2024

(54) PUMP MODULE

(71) Applicant: Edwards Vacuum LLC, Sanborn, NY (US)

(72) Inventor: Marcus Hans Robert Thierley, Shakopee, MN (US)

(73) Assignee: Edwards Vacuum LLC, Sandborn, NY (US)

( * ) Notice: Subject to any disclaimer, the term of this patent is extended or adjusted under 35 U.S.C. 154(b) by 53 days.

(21) Appl. No.: 17/905,581

(22) PCT Filed: Feb. 23, 2021

(86) PCT No.: PCT/IB2021/051504
§ 371 (c)(1),
(2) Date: Sep. 2, 2022

(87) PCT Pub. No.: WO2021/176301
PCT Pub. Date: Sep. 10, 2021

(65) Prior Publication Data
US 2023/0128669 A1 Apr. 27, 2023

(30) Foreign Application Priority Data
Mar. 5, 2020 (GB) ..... 2003216

(51) Int. Cl.
*F04B 37/02* (2006.01)
*F04B 37/14* (2006.01)
(Continued)

(52) U.S. Cl.
CPC ..... *F04B 37/02* (2013.01); *F04B 37/14* (2013.01); *F04B 39/12* (2013.01); *F04B 39/14* (2013.01)

(58) Field of Classification Search
CPC ..... F04B 37/02; F04B 37/14; F04B 39/12; F04B 39/14; F04B 39/121
See application file for complete search history.

(56) References Cited

U.S. PATENT DOCUMENTS 3,327,929 A * 6/1967 Dillenbeck ..... H01J 7/18 417/49
3,371,854 A * 3/1968 Herb ..... H01J 41/16 315/108
(Continued)

FOREIGN PATENT DOCUMENTS

CN 201092948 Y 7/2008
CN 102356236 A 2/2012
(Continued)

OTHER PUBLICATIONS

PCT Notification of Transmittal of the International Search Report and the Written Opinion of the International Searching Authority, or the Declaration dated May 20, 2021 and International Search Report dated May 20, 2021 for corresponding PCT application Serial No. PCT/IB2021/051502, 6 pages.
British Examination Report dated Jul. 29, 2020 and Search Report dated Jul. 28, 2020 for corresponding British application Serial No. GB2003215.7, 5 pages.
PCT Written Opinion dated May 20, 2021 for corresponding PCT application Serial No. PCT/IB2021/051502, 7 pages.
British Examination Report dated May 31, 2022 for corresponding British application Serial No. GB2003215.7, 3 pages.
(Continued)

*Primary Examiner* — Dominick L Plakkoottam
(74) *Attorney, Agent, or Firm* — Theodore M. Magee; Westman, Champlin & Koehler, P.A.

(57) ABSTRACT

Pump module for a vacuum apparatus with a flange which can be connected to a vacuum apparatus in a vacuum-tight manner, at least one ion getter pump and at least one volume getter pump, NEG, where the ion getter pump is directly connected to the flange and the NEG is directly connected to the ion getter pump and where the NEG and the flange are arranged separately from each other.

10 Claims, 3 Drawing Sheets

(51) Int. Cl.
*F04B 39/12* (2006.01)
*F04B 39/14* (2006.01)

(56) References Cited

U.S. PATENT DOCUMENTS

| | | | | |
|---|---|---|---|---|
| 8,287,247 | B2 * | 10/2012 | Bonucci | H01J 41/12 417/49 |
| 8,342,813 | B2 * | 1/2013 | Ferris | H01J 41/00 417/49 |
| 2004/0206239 | A1 * | 10/2004 | Laubacher | F17C 1/00 96/108 |
| 2006/0231773 | A1 * | 10/2006 | Katagiri | H01J 41/12 250/492.1 |
| 2007/0102650 | A1 | 5/2007 | Katagiri et al. | |
| 2012/0014814 | A1 * | 1/2012 | Bonucci | F04B 37/14 417/49 |
| 2016/0025583 | A1 | 1/2016 | Besling et al. | |
| 2016/0317971 | A1 * | 11/2016 | McMurtry | G01N 33/0036 |

FOREIGN PATENT DOCUMENTS

| | | | |
|---|---|---|---|
| CN | 205858605 | U | 1/2017 |
| CN | 108757380 | A | 11/2018 |
| DE | 3434787 | A1 | 4/1986 |
| DE | 102016105222 | A1 | 5/2016 |
| GB | 1127755 | | 9/1968 |
| JP | H1186777 | A | 3/1999 |
| JP | 2003343436 | A * | 12/2003 |
| WO | 2010105944 | A1 | 9/2010 |
| WO | 2021176300 | A1 | 9/2021 |

OTHER PUBLICATIONS

Agilent Technologies, Agilent 4UHV Ion Pump Controller Design to Optimize Pump Performance, Vacuum Solutions, Technical Overview, https://www.agilent.com/cs/library/technicaloverviews/public/5991-8141EN.pdf, 8 pages, May 24, 2017.

Saes Advanced Technologies, S.p.A., Operating Instructions, Nextorr D 100-5 Pump, https://mmrc.caltech.edu/Sample%20Suitcase/UHV%20suitcase/NexTorr%20100-5%20Manual.pdf, 18 pages, Jul. 29, 2013.

British Examination Report dated May 26, 2022 for corresponding British application Serial No. GB2003216.5, 5 pages.

British Examination Report dated Jul. 29, 2020 and Search Report dated Jul. 28, 2020 for corresponding British application Serial No. GB2003216.5, 5 pages.

PCT Notification of Transmittal of the International Preliminary Report on Patentability dated Apr. 22, 2022 and Response to Written Opinion dated Oct. 1, 2021 for corresponding PCT application Serial No. PCT/IB2021/051504, 21 pages.

PCT Notification of Transmittal of the International Search Report and the Written Opinion of the International Searching Authority, or the Declaration dated Apr. 23, 2021 for corresponding PCT application Serial No. PCT/IB2021/051504, 5 pages.

PCT Written Opinion of the International Searching Authority dated Apr. 23, 2021 for corresponding PCT application Serial No. PCT/IB2021/051504, 5 pages.

PCT Written Opinion of the International Preliminary Examining Authority dated Nov. 12, 2021 for corresponding PCT application Serial No. PCT/IB2021/051504, 6 pages.

Chinese Office Action dated Sep. 1, 2023 and Search Report dated Sep. 1, 2023 for corresponding Chinese application Serial No. 2021800190536, 7 pages.

* cited by examiner

PUMP MODULE

CROSS-REFERENCE TO RELATED APPLICATION

This application is a Section 371 National Stage Application of International Application No. PCT/IB2021/051504, filed Feb. 23, 2021, and published as WO 2021/176301 A1 on Sep. 10, 2021, the content of which is hereby incorporated by reference in its entirety and which claims priority of British Application No. 2003216.5, filed Mar. 5, 2020.

FIELD

The present invention relates to a pump module for a vacuum apparatus as well as to such a vacuum apparatus.

BACKGROUND

A large number of industrial and scientific instruments and systems require an ultrahigh vacuum with pressures lower than $10^{-7}$ mbar. For the generation of such a vacuum in a vacuum apparatus combinations of various pump systems are normally employed. Thus, a main pump (roughing or backing vacuum pump) is normally provided whereby a low vacuum with pressures of less than $10^{-1}$ mbar to $10^{-3}$ mbar is generated. The main vacuum pump is combined with a high vacuum pump for the generation of pressures of less than $10^{-3}$ mbar to $10^{-8}$ mbar, and possibly with an ultrahigh vacuum pump (UHV pump) for the generation of pressures lower than $10^{-7}$ mbar. UHV pumps include in such cases sorption pumps for the purpose of achieving the pressures necessary for the ultrahigh vacuum. Sorption pumps include, of course, ion getter pumps and volume getter vacuum pumps, volume getter vacuum pumps also being designated as getter pumps or volume getter pumps.

A large number of different gases may also be pumped by means of ion getter pumps. Ion getter pumps typically have two cathodes and one anode, between which a high voltage is applied. By means of the high voltage electrons are accelerated from the cathode to the anode and thereby ionise gas particles, which are then accelerated towards the cathode and there adsorbed or else reach the anode and are there implanted by their kinetic energy in the anode, so that in both cases they no longer contribute to the gas pressure. A magnetic field applied externally by a permanent magnet increases the potential for ionisation of the gas particles by the accelerated electrons. In that case the pump capacity of the ion getter pump is indicated by the size of the anode and cathode and is thus limited by the installation space available in a vacuum apparatus.

Known volume getter pumps work on the principle of the chemical sorption reactive gaseous media in particular, such as oxygen, nitrogen, hydrogen and the like, although with hydrogen physisorption predominates. Known volume getter pumps also have a 'non-evaporable getter material' (NEG). These volume getter pumps are designated on the basis of their getter material as NEGs. These pumps have a high sorption speed and thus also a high pumping speed, the pumping speed normally being higher than for ion getter pumps of the same size. A further advantage of volume getter pumps is that they allow hydrogen to be pumped more efficiently. However, the pumping effect of NEGs for hydrogen-carbon compounds is poor, and NEGs in particular are not capable of pumping noble gases.

The discussion above is merely provided for general background information and is not intended to be used as an aid in determining the scope of the claimed subject matter. The claimed subject matter is not limited to implementations that solve any or all disadvantages noted in the background.

SUMMARY

The technical problem of the present invention is to create a pump module for a vacuum apparatus with an ion getter pump and a volume getter pump, which is of compact design and is easy to connect to the vacuum apparatus.

This problem is solved by means of a pump module according to claim 1 as well as by a vacuum apparatus according to claim 9.

The pump module for a vacuum apparatus according to the invention has a flange which can be connected in a vacuum-tight manner to a vacuum apparatus. According to the invention, the pump module further comprises at least one ion getter pump and at least one volume getter pump (non-evaporable getter pump-NEG). The ion getter pump is in this case directly connected to the flange. The NEG is in turn directly connected to the ion getter pump, so that NEG and flange are so arranged that they are separated from each other. NEG and flange are thus arranged on opposite sides of the ion getter pump and are connected to the ion getter pump. The result is thus a stacked or layered structure with the following sequence starting from the flange: flange-ion getter pump-NEG. More specifically, ion getter pump and NEG are not connected at different positions on the flange. The result is a small-diameter pump module, since it is not necessary to choose a flange diameter which enables an ion getter pump and an NEG to be arranged side by side, nor is it necessary to provide two flanges for the ion getter pump and NEG. And owing to this reduced quantity and to the fact that a small diameter can be chosen, the tightness of the vacuum apparatus or flange is increased. The susceptibility of the vacuum apparatus to leakage is thus reduced. Consequently, it is possible to achieve a space-saving arrangement of ion getter pump and NEG using a small flange for the pump module, which is easily, and at lower cost, welded to the vacuum apparatus.

Preferably, the ion getter pump and NEG are arranged within the face of the flange. This means that the flange has a face area which is greater than the base area of the NEG and the base area of the ion getter pump. In this way, it is possible to introduce the pump module with ion getter pump and NEG into the flange and then to screw them with the flange onto the vacuum apparatus in a vacuum-tight manner.

Preferably, the ion getter pump and the NEG in installed state protrude into the vacuum apparatus. This ensures efficient pump performance. In particular, neither the ion getter pump nor the NEG is attached or connected to that side of the flange facing away from the vacuum apparatus. This avoids protrusion of the ion getter pump and/or NEG from the vacuum apparatus, so that the installation space required for the overall vacuum apparatus can be kept small.

It is preferred that a common lead-through is provided through the flange for the supply lines to the NEG and ion getter pump. The stacked structure makes it particularly easy to merge the supply lines within vacuum apparatus and then lead them out through the common lead-through. The common lead-through means that any leakage is reduced, and more particularly that the number of potential sources of malfunction and/or the susceptibility to leakage, which would otherwise prevent an ultrahigh vacuum from being efficiently achieved, is reduced.

Preferably, the flange has a first side and an opposite, second side, the NEG and the ion getter pump being arranged on the first side, and in particular connected to the first side so that they protrude from the first side. In this case the NEG is furthermore only indirectly connected to the flange via the ion getter pump. Ion getter pump and NEG are thus arranged on the same side of the flange. In particular, the first side is in installed state arranged within the vacuum apparatus, so that the first side is situated in the vacuum. The second side, on the other hand, is in installed state arranged outside the vacuum apparatus, and is thus normally exposed to an atmospheric pressure.

Preferably more than one ion getter pump is provided, each ion getter pump being directly connected to the flange. In order to increase the pump capacity of the pump module it may be necessary to provide more than one ion getter pump. This may then also be connected to the flange, and the ion getter pumps may for example be arranged side by side.

It is also preferable that more than one NEG be provided, each NEG being directly connected to an ion getter pump and each NEG being separated from the flange by one of the ion getter pumps. With this pump module configuration, the number of NEGs provided is always smaller than or equal to the number of ion getter pumps, so that for each combination of NEG and ion getter pump the serial or stacked structure according to the invention is chosen in order to further develop the compact design of the pump module.

As an alternative, more than one NEG may also be provided in such a way that at least one NEG is directly connected to the flange.

Preferably, at least one ion getter pump is permanently connected to the flange, and in particular integrally connected thereto, for example by welding. Alternatively, or in addition, at least one ion getter pump is permanently connected to the NEG, and in particular integrally connected thereto, for example by welding. It is also preferred that the ion getter pump is permanently connected both to the flange and to the NEG, an in particular essentially integrally connected thereto, for example by welding. It is particularly preferable that all ion getter pumps provided are connected in the same way to the flange and/or to the NEG.

By preference, at least one ion getter pump is detachably connected to the flange. Alternatively, or in addition, at least one ion getter pump is detachably connected to the NEG. In particular, the ion getter pump is detachably connected both to the flange and to the NEG. It is preferred if all ion getter pumps are detachably connected to the flange and/or the NEG. Such a detachable connection may for example be effected by means of a screw connection, a snap fitting, a bayonet connection or similar.

As an alternative, detachable and permanent connections may be employed between flange, ion getter pump and NEG, depending on the specific requirements for the application concerned. For example, a permanent connection between ion getter pump and flange may guarantee a particularly simple and secure pump module structure. However, detachable connection may for example allow independent removal and replacement of the NEG from the ion getter pump, if for example the provided NEG material has been used.

The present invention further relates to a vacuum apparatus with a flange, where a pump module as described above is connected to the flange.

Preferably, both the ion getter pump and the NEG protrude into the vacuum apparatus.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

The invention will now be described below in further detail on the basis of preferred embodiments with reference to the attached Drawings.

The Drawings show as follows.

DETAILED DESCRIPTION

Figure 1:
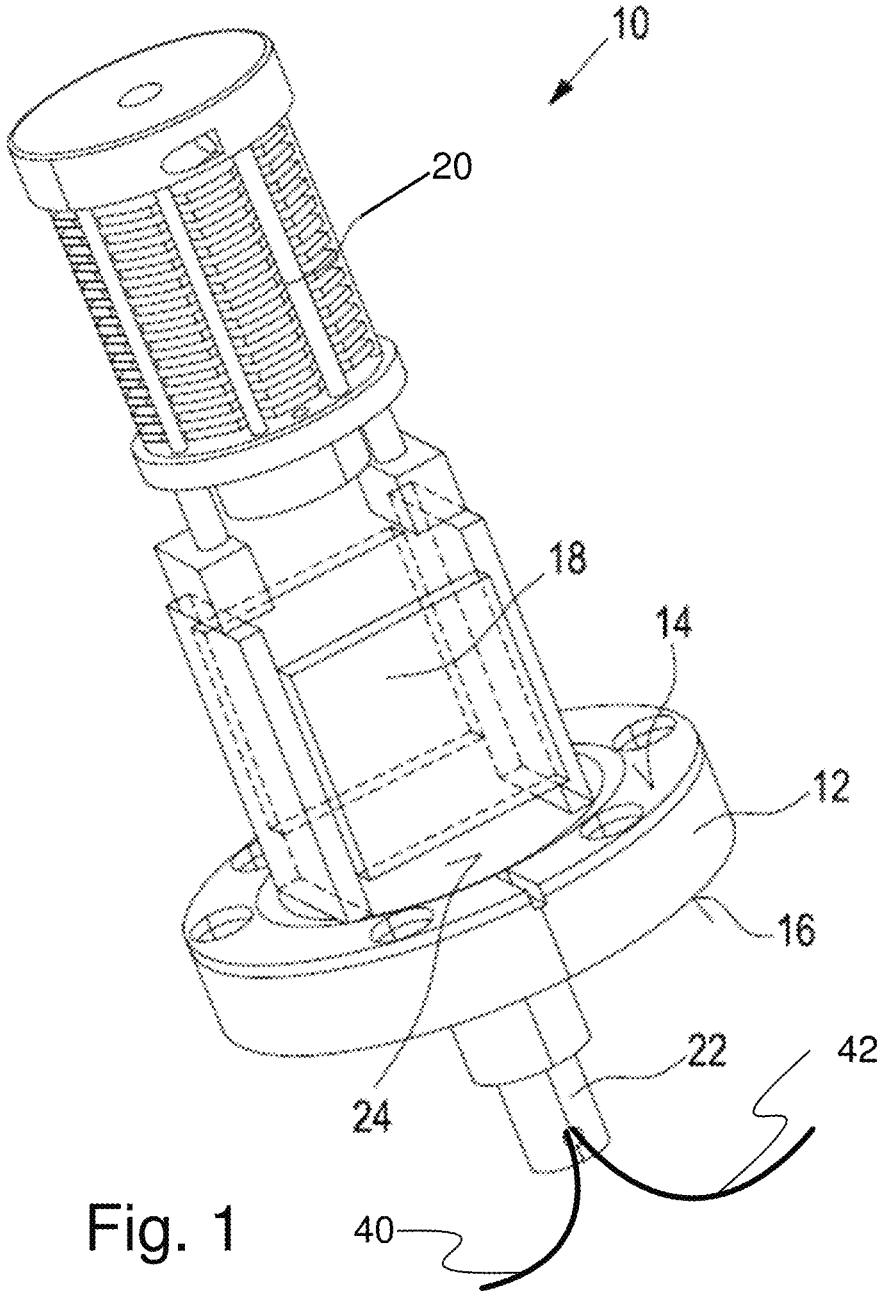
FIG. 1: a first embodiment of the pump module according to the invention
Figure 3:
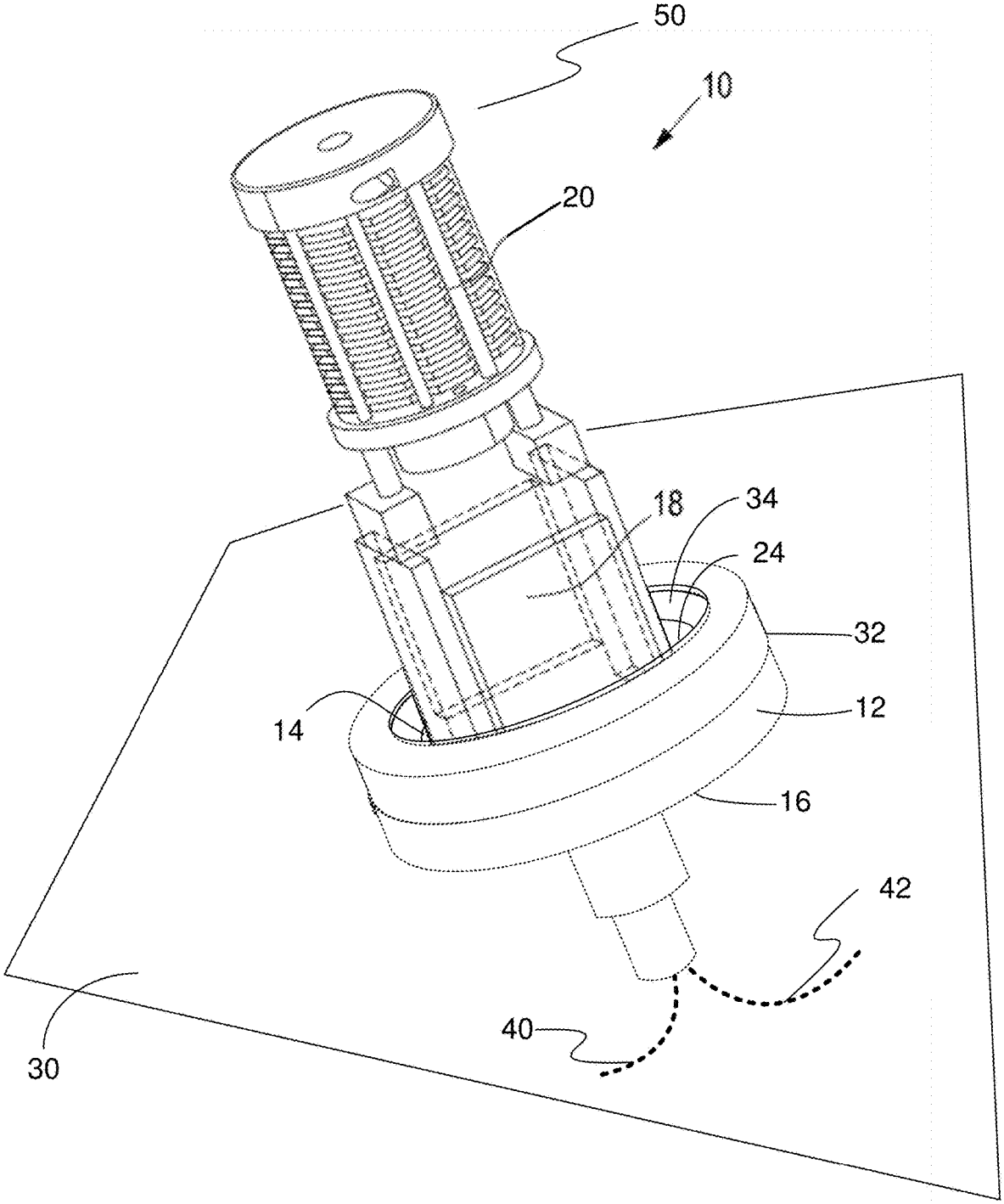
FIG. 3: a view from within a vacuum apparatus showing the first embodiment of the pump connected to the vacuum apparatus.

As shown in FIG. 1, the pump module 10 according to the invention has a flange 12 with a first side 14 and a second side 16, which lies opposite the first side. As shown in FIG. 3, when the flange 12 is connected to a vacuum apparatus 30 (only partially shown) having a flange 32 (with hidden portions shown in dotted lines), the first side 14 faces the interior of vacuum apparatus 30 and is in particular exposed to the vacuum created inside the vacuum apparatus 30. The second side 16 is exposed to an atmospheric pressure and is arranged outside the vacuum apparatus 30. With the aid of known means such as screws and seals, the flange 12 is connected to the flange 32 of the vacuum apparatus 30 in a vacuum-tight manner.

An ion getter pump 18 is connected to the first side 14 of the flange 12. A volume getter pump (NEG) 20 is arranged on that side of the ion getter pump 18 opposite to the flange 12 side. Flange 12 and NEG 20 are thus arranged at opposite ends of the ion getter pump. This means that NEG 20 is not directly connected to the flange 12, but rather indirectly by means of the ion getter pump 18. Thus, in the installed state of FIG. 3, ion getter pump 18 and NEG 20 protrude into the vacuum apparatus 30 and are so arranged therein to pump gases.

The flange 12 further possesses a common lead-through 22, by means of which the high voltage supply line 40 for operation of the ion getter pump 18 as well as the low voltage supply line 42 for the heating element for regeneration of the NEG are led through. This means that only one lead-through is necessary, so that the number of potential leaks of the ultrahigh vacuum apparatus can be reduced.

The diameter of the flange 12 can be kept small by virtue of the stacked or serial structure of NEG 20, ion getter pump 18 and flange 12, since the diameter of the flange or the diameter of the flange face 24, which is situated directly within the vacuum, corresponds exactly to, or is slightly greater than, the base area of the ion getter pump 18 or NEG 20. Thus, on installation as shown in FIG. 3, NEG 20 and ion getter pump 18 are introduced via a flange opening 34 in flange 32 and are attached securely to the vacuum apparatus by attachment of the flange 12 to the flange 32 of the vacuum apparatus 30.

Figure 2:
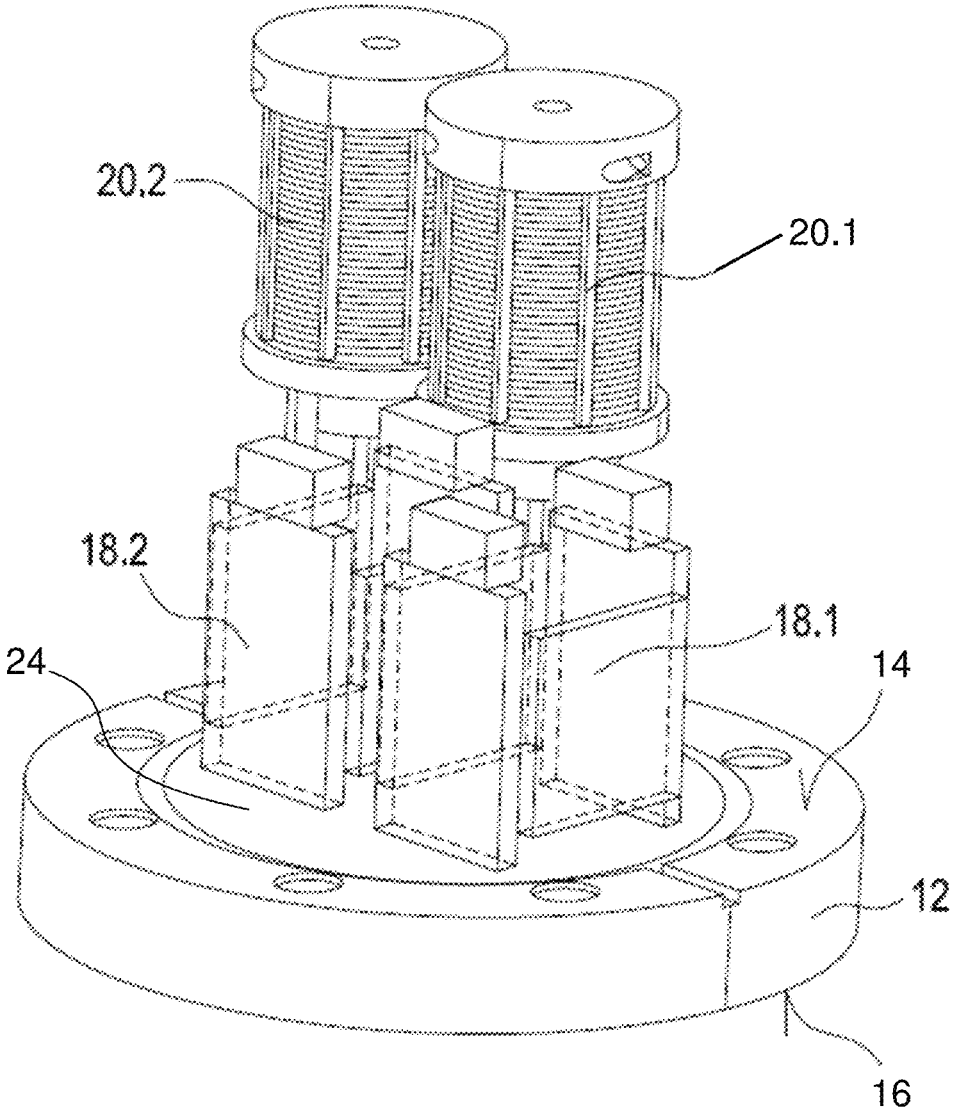
FIG. 2: a second embodiment of the pump module according to the invention.

FIG. 2 shows a further embodiment. Here, on the first side 14 of the flange 12 a first ion getter pump 18.1 and a second ion getter pump 18.2 are arranged. In this case, the ion getter pumps 18 are directly connected to the flange. On that side of the respective ion getter pumps 18.1, 18.2 opposite to the flange 12 side NEG 20.1, 20.2 is respectively arranged. This means that the pump capacity of the pump module can easily be doubled. At the same time, a compact structure is maintained by the stacked or serial arrangement of ion getter pump 18 and NEG.

Thus, a pump module is created which is compact in design and provides a combination of an ion getter pump and a NEG.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A pump module comprising:

a flange, configured to be connected to an exterior of a vacuum apparatus in a vacuum-tight manner, an ion getter pump and a volume getter pump, NEG, where the ion getter pump is directly connected to the flange and the NEG is directly connected to the ion getter pump, the NEG and the flange being arranged separately from each other, characterised in that the ion getter pump and the NEG are configured to be inserted into the vacuum apparatus while the ion getter pump is connected to the flange and the NEG is connected to the ion getter pump before the flange is connected to the exterior of the vacuum apparatus.

2. The pump module in accordance with claim 1, characterised in that a common lead-through for supply lines to the NEG and the ion getter pump is provided through the flange.

3. The pump module in accordance with claim 1, characterised in that the flange has a first side and an opposite, second side, the NEG and the ion getter pump being arranged on the first side and in particular protruding from the first side.

4. The pump module in accordance with claim 3, characterised in that in an installed state the first side faces the vacuum apparatus and the second side is in an installed state arranged outside the vacuum apparatus.

5. The pump module in accordance with claim 1, further comprising a second ion getter pump, the second ion getter pump being directly connected to the flange.

6. The pump module in accordance with claim 5, further comprising a second NEG directly connected to the second ion getter pump and the second NEG and the flange being arranged separately one from another.

7. The pump module in accordance with claim 1, characterised in that the ion getter pump is permanently connected to at least one of the flange and the NEG.

8. The pump module in accordance with claim 1, characterised in that the ion getter pump is detachably connected to at least one of the flange and the NEG.

9. A vacuum apparatus with a second flange, where the pump module in accordance with claim 1 is connected to the second flange.

10. The vacuum apparatus in accordance with claim 9, characterised in that the ion getter pump and the NEG both protrude into the vacuum apparatus at the second flange.

* * * * *